United States Patent [19]

Li et al.

[11] Patent Number: 4,616,204

[45] Date of Patent: Oct. 7, 1986

[54] CUT MAGNETIC CORE FORMED OF A GLASSY METAL ALLOY

[75] Inventors: Hsin L. Li, Parsippany; John D. Misson, Rumson; David G. Carrigan, Oak Ridge, all of N.J.

[73] Assignee: Allied Corporation, Morris Township, Morris County, N.J.

[21] Appl. No.: 626,256

[22] Filed: Jun. 29, 1984

Related U.S. Application Data

[62] Division of Ser. No. 406,664, Aug. 9, 1982, Pat. No. 4,046,753.

[51] Int. Cl.[4] ..... H01F 3/00

[52] U.S. Cl. ..... 335/297; 336/213; 336/218; 148/403

[58] Field of Search ..... 148/403; 335/296, 297, 335/281; 336/211, 212, 213, 216, 217, 218, 234

[56] References Cited

U.S. PATENT DOCUMENTS

| | | | |
|---|---|---|---|
| 3,497,949 | 3/1970 | Salt | 336/234 X |
| 3,538,601 | 11/1970 | Nerot et al. | 336/234 X |
| 4,416,709 | 11/1983 | Ohya et al. | 148/403 |
| 4,420,348 | 12/1983 | Shiiki et al. | 148/403 |
| 4,529,457 | 7/1985 | Kushnick | 148/403 |

*Primary Examiner*—George Harris

*Attorney, Agent, or Firm*—James Riesenfeld; Gerhard H. Fuchs

[57] ABSTRACT

The invention provides a method and apparatus for cutting a magnetic core spirally wound from a ribbon of glassy metal. The core is mounted on a mandrel, and a portion of the core is appointed to be cut. A clamping mechanism applies to the outside peripheral surface of said portion, a compressive clamping force directed toward said surface and normal thereto. A positioning mechanism locates and fixes the core and mandrel onto an indexing mechanism. The indexing mechanism moves the core and mandrel to a preselected fixed position, and a cutting mechanism cuts the core.

6 Claims, 7 Drawing Figures

FIG. 6
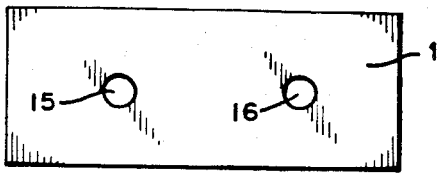
FIG. 7
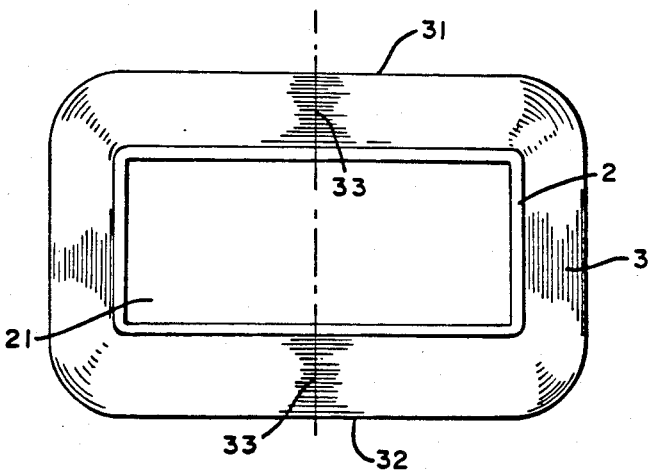
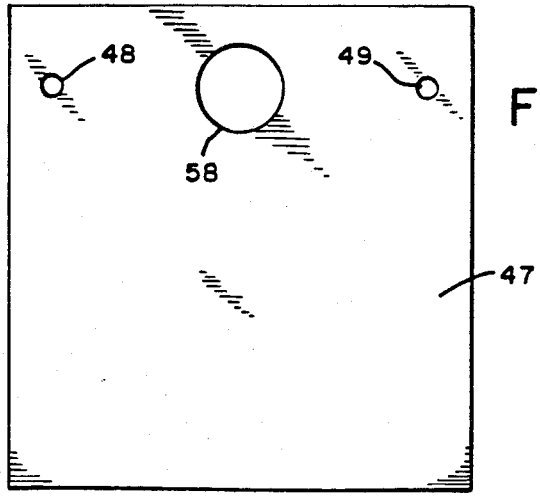
FIG. 5

CUT MAGNETIC CORE FORMED OF A GLASSY METAL ALLOY

This application is a division of application Ser. No. 406,664, filed Aug. 9, 1982, now U.S. Pat. No. 4,046,753.

BACKGROUND OF THE INVENTION

1. Field of the Invention

This invention relates to a method and apparatus for cutting laminated articles made from glassy metal alloy. More particularly, the invention relates to a method and apparatus for cutting magnetic cores spirally wound from ribbons of glassy metal alloys which will not delaminate or deform such cores.

2. Description of the Prior Art

It is well known that magnetic cores around which coils of wire can be wound are used in many electrical components such as inductors, transformers and the like. The cores often define substantially closed loop magnetic circuits, such as toroids, but in some applications, air gaps are introduced in the magnetic core circuits to increase the magnetic reluctance of the circuit and to produce certain desirable magnetic characteristics. Such cores, generally referred to as cut cores, are used in devices such as transformers, inductors and motor starters. The applications often employ "C" type cut cores wherein an oval or rectangular shaped, closed loop core is cut to create matching C-shaped cores. Such cut cores have a high reluctance air gap which can be adjusted by inserting suitable spacers between the matching surfaces of the mated C-cores to tailor the magnetic circuit characteristics to the particular application. To obtain the desired magnetic circuit characteristics, it is important that the mating ends of the cut cores are well matched; as close as possible to 100 percent of the surface areas of the mated ends of the cut cores should be in contact. If the ends are mismatched, the power loss in the core and the VA (volt-ampere) characteristic of the core are adversely affected.

Present cores are ordinarily wound from tapes or ribbons of crystalline metals, such as iron nickel (FeNi) and iron silicon (FeSi) alloys, wherein the wound construction, providing successive multiple layers of material, has the advantage of reducing core power losses caused by eddy currents. Since the crystalline metal alloys are ductile and have low yield stresses, the tapes are easily wound into the desired shapes. Once wound and annealed, the tape material takes a permanent "set" and contains little residual stress. Conventional binding methods such as resin impregnation of the laminations, core edge coatings and plastic cladding of the wound core are then sufficient to hold the laminations in place during subsequent manufacturing operations. The cores can be cut with conventional cutting means, such as blades and cutting wheels, without special handling procedures, and when cut, the cores retain their shape. The cut ends, after grinding and polishing will match well and have little tendency to bow outwardly creating mismatched C-cores.

Because of the favorable magnetic properties of glassy metal alloys, such as high magnetic permeability, low core loss and low VA characteristics, they are especially useful as magnetic core material. Glassy metal alloys, however, are thinner, tougher, harder and more elastic than the crystalline metal alloys ordinarily used in magnetic cores. As a result, they are less easily wound into the desired core shapes and are less likely to maintain the shapes after the wound cores are cut. In addition, glassy metal tapes and ribbons have some variations in thickness because of the way those materials are manufactured. Consequently, winding glassy metal ribbons to produce a closed loop core shape induces significant internal residual stresses which cannot be completely relieved by annealing the wound cores. Resin impregnation of the core laminations, core edge coatings and plastic claddings can add rigidity and help hold the core laminations together, but even when these preparatory procedures are used, glassy metal cores cannot be satisfactorily cut using ordinary cutting procedures. The layers still tend to delaminate, and the cut ends tend to deform and twist out of position creating mismatched core ends. As a result, the apparatus and procedures ordinarily used to cut magnetic cores wound from glassy metal ribbons produce delaminated and deformed cores having degraded electromagnetic characteristics.

SUMMARY OF THE INVENTION

This invention provides a method and fixturing apparatus for cutting a magnetic core spirally wound from a ribbon of glassy metal alloys which will not delaminate or deform the core.

In accordance with the invention, a magnetic core is formed by spirally winding a ribbon of glassy metal magnetic material into successive, multiple layers around a form having a preselected shape. After the core is annealed, a binding means is used to bind the layers of the core material together. The core is then mounted on a mandrel, and a portion of the core is appointed to be cut. A clamping means applies to the outside peripheral surface of said portion a compressive clamping force directed toward said surface and normal thereto. Positioning means locate and fix the core and mandrel onto an associated indexing means which moves the core and mandrel to a preselected fixed position. A cutting means then cuts the core.

The apparatus of the invention includes a mandrel for mounting thereon a core having at least one portion appointed to be cut. A clamping means applies to the outside peripheral surface of said portion a compressive clamping force directed toward said surface and normal thereto. Indexing means move said core and said mandrel into a preselected fixed position, and positioning means for locating and fixing said mandrel onto said indexing means.

The cutting method and apparatus of this invention reliably cuts magnetic cores without causing delamination or bulging of the material. There is substantially complete surface area contact between the mating ends of the cut C-core, even without a grinding or polishing of the cut ends. As a result, the C-core is more efficiently produced and has greatly improved electromagnetic characteristics compared to cores wound from crystalline metal tapes. In addition, binding methods ordinarily used in the art to hold wound laminations together can still be used with glassy metal alloy magnetic cores. Thus, no special binding system is required which could increase manufacturing costs.

BRIEF DESCRIPTION OF THE DRAWINGS

The invention will be more fully understood and further advantages will become apparent when reference is made to the following detailed description and the accompanying drawings in which:

FIG. 5 is a plan view of an indexing plate;

FIG. 6 is a plan view of a mandrel; and

FIG. 7 is a plan view of a cut core illustrating the C-cores created therefrom.

DESCRIPTION OF THE PREFERRED EMBODIMENTS

Referring to FIG. 7, there is illustrated a typical magnetic core 3 spirally wound from a ribbon of glassy metal alloy. After annealing the wound core and applying a binding means, core 3 is cut to produce cut type C-cores.

Figure 1:
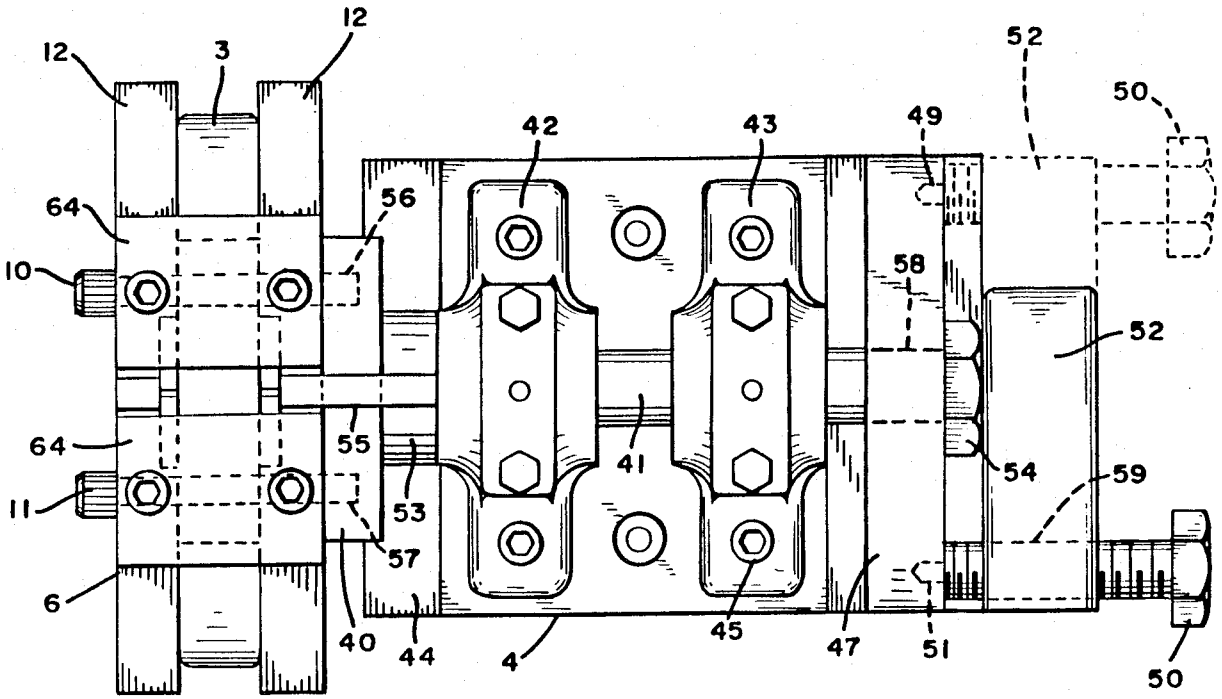
FIG. 1 is a top plan view of an uncut core mounted on the apparatus of the invention.
Figure 2:
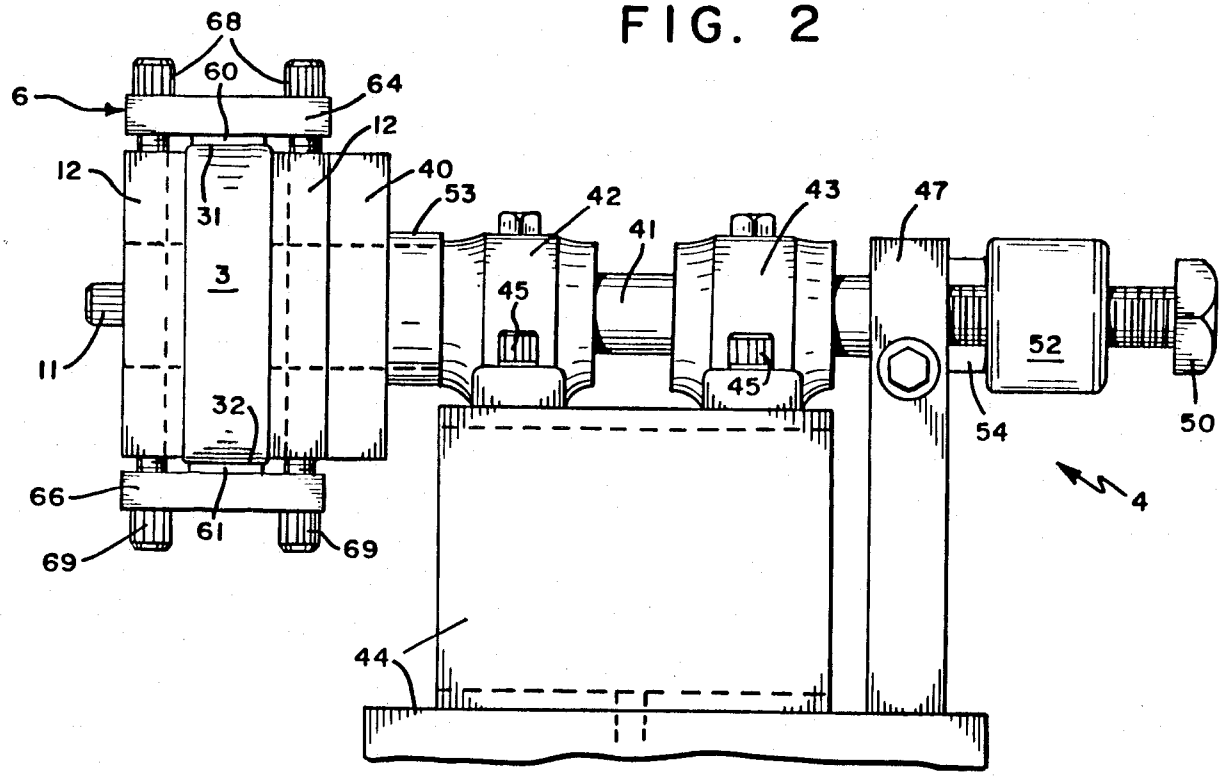
FIG. 2 is a side view of an uncut core mounted on the apparatus of the invention.
Figure 3:
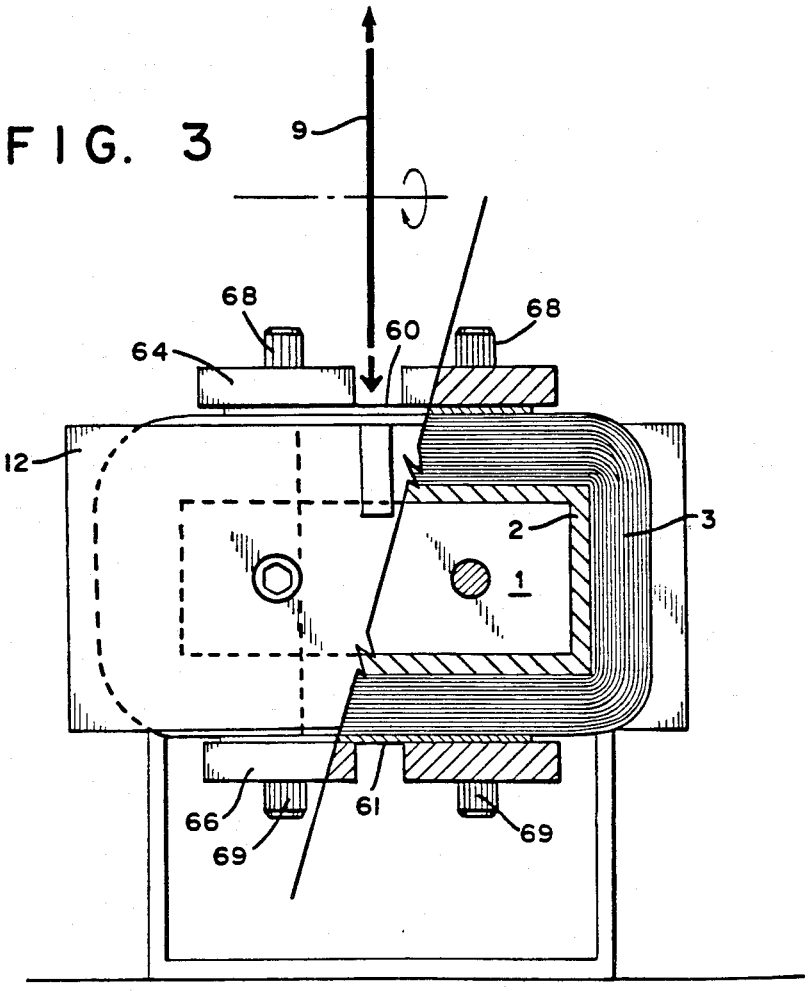
FIG. 3 is a front view of an uncut core mounted on the apparatus of the invention.

FIGS. 1, 2 and 3, show an apparatus for fixturing core 3 to produce a cut core. Core 3 is mounted on mandrel 1 which has positioning means for locating and fixing it to indexing means 4. A clamping means 6 applies a clamping force to the outside surface of that portion of core 3 which is to be cut, and indexing means 4 selectively moves and fixes core 3 into cutting relation to a cutting means 9.

The glassy metal ribbon of which core 3 is comprised is prepared by cooling a melt of the desired composition at a rate of at least about $10^{4°}$ C. per second, employing metal alloy quenching techniques well known to the glassy metal alloy art; see, e.g., U.S. Pat. No. 3,856,513 to Chen et al. The purity of all compositions is that found in normal commercial practice. A variety of techniques are available for fabricating continuous ribbon, wire, sheet, etc. Typically, a particular composition is selected, powders or granules of the requisite elements in the desired portions are melted and homogenized, and the molten alloy is rapidly quenched on a chill surface, such as a rapidly rotating metal cylinder.

Under these quenching conditions, a metastable, homogeneous, ductile material is obtained. The metastable material may be glassy, in which case there is no long range order. X ray diffraction patterns of glassy metal alloys show only a diffuse halo, similar to that observed for inorganic oxide glasses. Such glassy alloys must be at least 50 percent glassy to be sufficiently ductile to permit subsequent handling, such as winding magnetic cores from ribbons of the alloy, without degradation of the magnetic characteristics. Preferably, the glassy metal must be at least 80 percent glassy to obtain superior ductility. The metastable phase may also be a solid solution to the constituent elements. In the case of the ribbon used with the invention such metastable, solid solution phases are not ordinarily produced under conventional processing techniques employed in the art of fabricating crystalline alloys. X ray diffraction patterns of the solid solution alloys show the sharp diffraction peaks characteristic of crystalline alloys, with some broadening of the peaks due to desired fine grained size of crystallites. Such metastable materials are also ductile produced under the conditions described above.

FIG. 7 illustrates a magnetic core 3 made by spirally winding a glassy metal ribbon around a frame 2 which has a preselected shape, such as an oval or the shown rectangle. The spiral windings form successive multiple layers which build up a desired thickness of core material around frame 2. Preferably, frame 2 is made of a material that is sufficiently rigid to prevent twisting of the core after it is cut. Where the cross-sectional dimensions of the cut portion of core 3 are relatively small, measuring less than approximately 0.5 in×0.5 in, frame 2 may not be needed to prevent twisting of the cut core. In such case, frame 2 can be removed from core 3 after the core is wound.

After winding core 3, it is annealed, preferably in a magnetic field, to relieve residual stresses induced by the winding operation and to optimize the magnetic characteristics. Then, a binding means, such as a resin impregnation under vacuum, a core edge coating or a plastic cladding is applied to core 3 to add rigidity and to help hold the laminated layers of the core together. Thus prepared, core 3 is mounted onto mandrel 1 of the invention.

Mandrel 1, as shown in FIG. 6, is made of a suitable material, such as metal, and is sized to fit closely into window 21 delimited by the inside peripheral surface of frame 2. The fit between frame 2 and mandrel 1 should be sufficiently close to insure that substantially no motion occurs between mandrel 1 and frame 2 during the cutting operation. If frame 2 has been removed, mandrel 1 should fit closely with the inside surface of core 3. A positioning means for locating and fixing mandrel 1 to indexing means 4 is comprised of locator bolts 10 and 11 which engage holes 15 and 16 through mandrel 1. Holes 15 and 16 are suitably sized and located to accommodate sliding engagement by locator bolts 10 and 11.

Clamping means 6, which applies an inwardly directed clamping force against the outside peripheral surface of the portion of core 3 that is appointed to be cut, comprises: a clamp attachment means, a force transfer means and a means for applying a compressive clamping force. All components of clamping means 6 are made of a suitable material such as metal or plastic.

Figure 4:
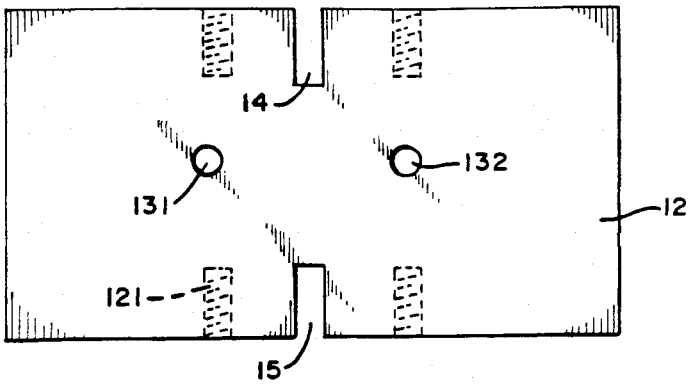
FIG. 4 is a plan view of a clamp attachment plate.

Two clamp attachment plates 12 comprise the clamp attachment means and are disposed to sandwich the assembly of core 3 and mandrel 1 there between. Attachment plate 12, as shown in FIG. 4, has locator holes 131 and 132 that are aligned with holes 15 and 16, respectively, in mandrel 1 and adapted to accept engagement by bolts 10 and 11. In addition, attachment plates 12 have slots 14 and 15 to accommodate the passage of cutting means 9.

Disposable strips 60 and 61 comprise the force transfer means. In the shown embodiment, strips 60 and 61 are placed against the outside peripheral surfaces 31 and 32 of core 3 and extend over the portions of core 3 that are appointed to be cut. It is important to maintain a compressive clamping force at the very edge of a cut through core 3 in order to prevent delamination and bulging of the core material at cut surface 33. Consequently, strips 60 and 61 are comprised of a material sufficiently rigid to transfer and distribute the applied clamping force to the edge of the intended cut through core 3.

Top clamp plates 64, bottom clamp plates 66 and clamp bolts 68 and 69 comprise the means for applying the compressive clamping force. Two top clamp plates 64 are positioned against top strip 60, one on each side of slot 14. A selected clamping force is directed normal to core surface 31 and applied against strip 60 and core surface 31 by tightening clamp bolts 68 which pass through clamp plates 64 and engage threaded holes 121 located in attachment plates 12. Similarly, two bottom clamp plates 66 are positioned against bottom strip 61, one on each side of slot 15. A selected clamping force is directed normal to core surface 32 and is applied against strip 61 and core surface 32 by tightening clamp bolts 69 which pass through clamp plates 66 and engage threaded holes located in attachment plates 12.

Indexing means 4 is comprised of base 44, mandrel mounting plate 40, rotatable shaft 41, shaft bearings 42 and 43, shaft crank 52, and a shaft locking means, all of which can be made of a suitable material such as metal.

Bearings 42 and 43 are attached to base 44 with suitable fastening means, such as bolts 45, and shaft 41 is rotatably mounted therein. Mandrel mounting plate 40 is fixedly attached to one end of shaft 41 to rotate therewith and is provided with threaded holes 56 and 57 suitably located and sized for threaded engagement by locator bolts 10 and 11. The remaining, opposite end of shaft 41 passes through and is rotatable within hole 58 located through indexing plate 47, which is rigidly fixed to base 44. Crank 52 is fixedly attached to and adapted to rotate shaft 41. Crank 52 has a threaded hole 59 there through which is adapted to engage locking bolt 50.

The locking means is comprised of locking bolt 50 and indexing plate 47. Locking bolt 50 has an index locator pin 51 which engages corresponding indexing holes 48 and 49 located in indexing plate 47. Indexing holes 48 and 49 are located in preselected positions to engage locking bolt locator pin 51 and to precisely fix the angular rotational position of crank 52 and shaft 41. This in turn fixes the angular position of core 3 and precisely orients core 3 into preselected positions. In the shown embodiment, the apparatus is constructed and arranged to index core 3 to two positions 180° apart, orienting those portions of core 3 that are appointed to be cut in a substantially horizontal position. Spacers 53 and 54 position shaft 41 axially within bearings 42 and 43.

Cutting means 9 is a suitable cutter, such as a blade or cutting wheel, which in the embodiment shown is disposed above core 3.

In the operation of the apparatus of this invention, core 3 is mounted onto mandrel 1 and the assembly is sandwiched between two attachment plates 12. After strips 60 and 61 are clamped against the portions of core 3 appointed to be cut using clamp plates 64 and 66 and clamp bolts 68 and 69, the resultant configuration is attached to indexing means 4 with locator bolts 10 and 11. Core 3 is then indexed by rotating shaft 41 to a first position with core surface 31 facing upward, and lock bolt 50 is tightened to engage pin 51 into the corresponding index hole in index plate 47. This fixes the rotational position of core 3. Cutting means 9 is brought down into cutting relation with core 3 to cut through strip 60, through core surface 31, and through the corresponding portions of core 3 and frame 2. When the first cut is complete, lock bolt 50 is loosened, core 3 is indexed to a second position 180° around from the first position and lock bolt 50 is again tightened to fix the position of core 3. Cutting means 9 is now brought down to cut through strip 61, core surface 32, and through the corresponding portions of core 3 and frame 2. When both cuts are completed, core 3 is removed from the apparatus and separated into matching C-shaped cut cores. The cut surfaces 33 of core 3 produced by the method and apparatus described above are substantially free from delaminations and bulges, and do not need the subsequent polishing or lapping required when crystalline metal cores are cut. Separated portions of the cut core maintain their shape and alignment and have substantially total contact between the mating surfaces of the cut core.

For example, a glassy metal alloy ribbon 0.5 in wide and 0.0012 in thick was wound onto a rectangular frame measuring 2.4"×1"×0.5" made from 1/16 in thick stainless steel strip. Approximately 400 winds of material were made to produce a rectangular core having successive laminations built up to a thickness of approximately 0.5 in. The wound core weighed 195 gm and was field annealed under a 1 Oersted field at 400° C. for 2 hrs. The annealed core was then coated with epoxy resin and placed in a vacuum oven at 110° C. and 0.5 mm Hg vacuum for approximately 10 minutes during which time the liquid epoxy resin impregnated between the wound laminations to a depth of approximately 30% of the ribbon width. The core was then mounted in the apparatus of this invention and cut into a pair of C-type cores. The resultant cut core exhibited the electromagnetic characteristics set forth in Table 1 below. For the purpose of comparison, Table 1 also shows the electromagnetic characteristics of similar cut cores made from FeSi and FeNi.

TABLE 1

| | Core Loss @ 50 Hz, 1.4 Tesla | |
|---|---|---|
| | Watts/kg | VA/kg |
| $Fe_{78}B_{13}Si_9$ (Glassy Metal Alloy) | 33 | 80 |
| FeSi (Crystalline Alloy) | 77 | 210 |
| FeNi (Crystalline Alloy) | 80 | 210 |

In contrast, when a glassy metal wound core was cut employing the conventional methods used to cut wound cores, the core delaminated so badly that it was unusable, and meaningful electrical measurements could not be made.

Having thus described the invention in rather full detail, it will be understood that these details need not be strictly adhered to but that various changes and modifications may suggest themselves to one skilled in the art, all falling within the scope of the invention as defined by the sub-joined claims.

We claim:

1. A cut magnetic core, prepared by the process comprising:

spirally winding a magnetic glassy metal alloy into successive, multiple layers to form a core having a substantially closed loop magnetic circuit and cutting through the closed core to form mating, cut surfaces that are substantially free of delaminations.

2. A cut magnetic core as recited in claim 1, further comprising a frame on which said glassy metal alloy is spirally wound.

3. A cut magnetic core as recited in claim 1, wherein said cut core forms C-shaped cut core portions.

4. A cut magnetic core as recited in claim 1, further comprising binding means applied to said core for helping to hold said wound layers together.

5. A cut magnetic core, comprising:

a. a frame;

b. a magnetic, glassy metal alloy which is spirally wound on said frame into successive, multiple layers to form a core having a substantially closed loop magnetic circuit;

c. binding means applied to said core for helping to hold said wound layers together; and d. said core having been cut therethrough to form mating, cut surfaces which are substantially free of delaminations.

6. A cut magnetic core as recited in claim 5, wherein said cut core forms C-shaped cut core portions.

* * * * *